US009970401B2

(12) United States Patent
Marc et al.

(10) Patent No.: US 9,970,401 B2
(45) Date of Patent: May 15, 2018

(54) FUEL CUP

(71) Applicant: Continental Automotive GmbH, Hannover (DE)

(72) Inventors: Daniel Marc, Leghorn (IT); Andrea Puccini, San Miniato (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 683 days.

(21) Appl. No.: 13/678,079

(22) Filed: Nov. 15, 2012

(65) Prior Publication Data

US 2013/0074951 A1 Mar. 28, 2013

Related U.S. Application Data

(63) Continuation-in-part of application No. PCT/EP2011/056351, filed on Apr. 20, 2011.

(30) Foreign Application Priority Data

May 18, 2010 (EP) ..... 10005188

(51) Int. Cl.
*F02M 61/16* (2006.01)
*F02M 61/14* (2006.01)

(52) U.S. Cl.
CPC ..... *F02M 61/16* (2013.01); *F02M 61/14* (2013.01); *F02M 61/168* (2013.01);
(Continued)

(58) Field of Classification Search
CPC ..... F02M 2200/8084; F02M 61/14; F02M 2200/856; F02M 2200/855; F02M 2200/853; F02M 2200/852; F02M 2200/851; F02M 2200/85; F02M 61/16; F02M 61/168; F16L 37/12; F16L 37/0847; F16L 37/04; F16L 37/098; F16L 37/086;
(Continued)

(56) References Cited

U.S. PATENT DOCUMENTS 115,917 A * 6/1871 Wharton ..... F16L 27/0828 285/276
146,367 A * 1/1874 Smith ..... F16L 37/107 137/599.02
(Continued)

FOREIGN PATENT DOCUMENTS

CN 1478176 A 2/2004 ..... F02M 55/00
DE 10163030 A1 7/2003 ..... F02M 55/00
(Continued)

OTHER PUBLICATIONS

Chinese Office Action, Application No. 201180024520.0, 13 pages, dated Mar. 21, 2014.
(Continued)

*Primary Examiner* — Sizo Vilakazi
*Assistant Examiner* — Brian Kirby
(74) *Attorney, Agent, or Firm* — Slayden Grubert Beard PLLC

(57) ABSTRACT

A fuel cup including a central longitudinal axis and being fixable to an injector via a holder comprises a fuel cup body and a fixing element. This fuel cup is wherein said fixing element is a stamped tab affixed to said fuel cup body, and in that said stamped tab is designed to be engaged to said holder.

8 Claims, 5 Drawing Sheets

(52) U.S. Cl.
CPC ..... *F02M 2200/16* (2013.01); *F02M 2200/80* (2013.01); *F02M 2200/8023* (2013.01); *F02M 2200/856* (2013.01); *Y10T 137/6851* (2015.04)

(58) Field of Classification Search
CPC ..... F16L 37/107; F16L 37/133; F16L 37/256; F16L 59/188; F16L 37/1205; Y10T 29/49826; Y10T 29/49947; Y10T 29/53; Y10T 403/7015; Y10T 403/7094; Y10T 24/45052; Y10T 24/45058; Y10T 24/45215; Y10T 24/45089; Y10T 24/45508; Y10T 24/505; F16B 21/075–21/076; F16B 7/0473; F16B 7/048; F16B 5/0036
USPC ..... 123/470; 228/175, 174; 285/305, 317, 285/319; 29/230; 248/314; 24/601.6, 24/601.4, 598.4, 100.5, 316
See application file for complete search history.

(56) References Cited

U.S. PATENT DOCUMENTS 357,944 A * 2/1887 Stout ..... F16B 21/06 137/99
461,751 A * 10/1891 Goldman ..... F16L 27/0849 285/283
753,096 A * 2/1904 Osteen ..... F16L 27/0849 285/283
909,131 A * 1/1909 Antic ..... F16L 37/084 285/148.14
1,604,931 A * 10/1926 Peterson ..... E04B 1/185 52/283
1,688,980 A * 10/1928 Miller ..... B23K 33/004 219/137 R
2,038,439 A * 4/1936 Moss ..... B23K 5/006 219/137 R
2,068,564 A * 1/1937 Osborn ..... B21D 49/00 29/243.57
2,075,052 A * 3/1937 Pasman ..... A47K 3/38 285/319
2,225,394 A * 12/1940 Tinnerman ..... F16B 5/125 24/295
2,303,743 A * 12/1942 Jourdan ..... F16L 25/0027 285/305
2,406,895 A * 9/1946 Olson ..... H01R 13/28 24/589.1
2,433,987 A * 1/1948 Gleitz ..... D01H 7/10 242/597
2,451,591 A * 10/1948 Tinnerman ..... F16B 5/125 24/453
2,520,725 A * 8/1950 Judd ..... E05C 19/06 174/371
2,668,998 A * 2/1954 Tinnerman ..... F16B 2/241 24/662
2,696,994 A * 12/1954 Paulsen ..... F16L 21/005 285/253
2,947,055 A * 8/1960 McHenry ..... A61B 17/122 24/20 EE
3,203,714 A * 8/1965 Cronk, Jr. ..... F16L 37/113 285/281
3,531,618 A * 9/1970 Merchant ..... B23K 11/002 219/101
3,898,713 A * 8/1975 Nelson ..... F16B 2/08 24/543
4,036,515 A * 7/1977 Karcher ..... F16L 37/133 285/315
4,168,795 A * 9/1979 Bennett ..... B23K 28/02 219/137 R
4,570,600 A * 2/1986 Atkins ..... F02M 69/54 123/456
4,699,444 A * 10/1987 Isohata ..... H01R 13/113 439/839
4,809,743 A * 3/1989 Sukimoto ..... B21C 37/29 123/456
4,915,643 A * 4/1990 Samejima ..... H01R 13/6272 439/357
5,042,269 A * 8/1991 Sullivan ..... F04D 25/16 285/319
5,136,999 A * 8/1992 Bassler ..... F02M 55/004 123/456
5,141,397 A * 8/1992 Sullivan ..... F04D 29/4233 285/319
5,197,164 A * 3/1993 Meier ..... A44B 11/22 24/16 PB
5,209,204 A * 5/1993 Bodenhausen ..... F02M 51/005 123/456
5,350,314 A * 9/1994 Saba ..... F02M 51/005 123/470
5,394,850 A * 3/1995 Murphy ..... F02M 35/10216 123/470
5,520,151 A * 5/1996 Gras ..... F02M 41/14 123/469
5,647,759 A * 7/1997 Lien ..... F21V 19/0005 439/356
5,803,052 A 9/1998 Lorraine et al. ..... 123/470
5,882,048 A * 3/1999 Kawasaki ..... F16L 11/11 285/319
6,019,089 A * 2/2000 Taylor ..... F02M 61/145 123/456
6,039,615 A * 3/2000 Suzuki ..... H01R 13/113 439/849
6,193,540 B1 * 2/2001 Tseng ..... F21V 19/0005 362/653
6,226,868 B1 * 5/2001 Fujino ..... F02M 61/145 29/890.14
6,270,044 B1 * 8/2001 Kakehi ..... B23K 9/201 228/175
6,283,772 B1 * 9/2001 Braun ..... F02M 55/00 123/470
6,314,943 B1 * 11/2001 Burch ..... F02M 61/14 123/456
6,318,410 B1 * 11/2001 Miyajima ..... B29C 49/20 138/109
6,360,723 B1 * 3/2002 Nomura ..... F02M 61/14 123/468
6,382,187 B1 * 5/2002 Scollard ..... F02M 55/004 123/468
6,423,053 B1 * 7/2002 Lee ..... A61M 39/1011 604/523
6,457,456 B1 * 10/2002 Scollard ..... F02M 61/145 123/470
6,481,420 B1 * 11/2002 Panasuk ..... F02M 55/004 123/469
6,484,981 B1 * 11/2002 Perrault ..... A63B 27/00 182/92
6,612,528 B2 * 9/2003 Collins ..... F02M 61/14 248/300
6,668,803 B1 * 12/2003 McClean ..... F02M 61/14 123/456
6,705,292 B2 * 3/2004 Bugos ..... F02M 61/14 123/456
6,830,035 B2 * 12/2004 Nishiwaki ..... F02M 61/14 123/470
6,886,522 B1 * 5/2005 Lawrence ..... F02F 1/40 123/195 R
6,892,704 B2 * 5/2005 Tsuchiya ..... F02M 55/025 123/456
6,959,695 B2 * 11/2005 Warner ..... F02M 51/005 123/456
6,959,878 B1 * 11/2005 O'Brien ..... F02M 55/02 239/5
7,044,677 B2 * 5/2006 Moser ..... B21D 39/038 228/135
7,063,075 B2 6/2006 Berger et al. ..... 123/470
7,360,524 B2 * 4/2008 Zdroik ..... F02M 55/005 123/469
7,398,767 B2 * 7/2008 Kondo ..... F02M 61/145 123/468

(56) References Cited

U.S. PATENT DOCUMENTS 7,438,055 B1 * 10/2008 Xu ..... F02M 61/14 123/456
7,458,619 B2 * 12/2008 Cassel ..... F01N 13/1805 24/279
8,997,717 B2 * 4/2015 Roseborsky ..... F02M 61/14 123/470
9,033,290 B2 * 5/2015 Shepard ..... F16L 3/1025 248/62
2002/0130237 A1 * 9/2002 Kluser ..... F16B 5/0685 248/316.1
2002/0175258 A1 * 11/2002 White ..... B23P 15/00 248/314
2003/0183200 A1 * 10/2003 Bugos ..... F02M 55/025 123/470
2009/0056674 A1 * 3/2009 Furst ..... F02M 61/14 123/470
2009/0102224 A1 * 4/2009 Rohee ..... B60N 2/0732 296/65.14
2009/0178650 A1 * 7/2009 Zdroik ..... F02M 61/14 123/470
2010/0012093 A1 * 1/2010 Pepperine ..... F02M 55/004 123/470
2010/0218743 A1 * 9/2010 Marc ..... F02M 55/025 123/470

FOREIGN PATENT DOCUMENTS

EP 1046810 A2 10/2000 ..... F02M 61/14
EP 1892408 A1 * 2/2008 ..... F02M 61/14
GB 2324337 A * 10/1998 ..... F02M 61/145
WO 2011/144411 A1 11/2011 ..... F02M 55/00

OTHER PUBLICATIONS

International Search Report and Written Opinion, Application No. PCT/EP2011/056351, 7 pages, dated May 25, 2011.
Korean Office Action, Application No. 2017059856518, 4 pages, dated Aug. 28, 2017.

* cited by examiner

FUEL CUP

CROSS-REFERENCE TO RELATED APPLICATIONS

This application is a Continuation-In-Part of International Application No. PCT/EP2011/056351 filed Apr. 20, 2011, which claims priority to EP Patent Application No. 10005188.7 filed May 18, 2010. The contents of which is incorporated herein by reference in its entirety.

TECHNICAL FIELD

This disclosure relates to a fuel cup being fixable to an injector via a holder, whereby the fuel cup comprises a fixing element.

BACKGROUND

EP 1 892 408 A1 discloses a fuel cup comprising above mentioned features. With this prior art fuel cup said fixing element is an integral part of the fuel cup in the form of a T-shaped protrusion of the outer surface of the fuel cup. Such a fuel cup can only be produced either by machining or by casting. However, such methods are expensive and technically complicated because of long machining time needed and because of the tiny dimension of the protrusion. On the other hand, deciding for casting as a method for producing such a fuel cup implies a large amount of tooling investment, which may be justified only for big volume production, but not for producing smaller lots of fuel cups of one and the same type. And in fact each type of fuel cups (and the respective holders and injectors) is designed and adapted to be used with a specific, given type of internal combustion engine. Accordingly, in practice the lots of identical fuel cups to be produced are not too big, and producing fuel cups of a given type having a fixing element as an integral part thereof by casting is also too expensive.

SUMMARY

In one embodiment, a fuel cup including a central longitudinal axis, said fuel cup being fixable to an injector via a holder, and said fuel cup comprising a fuel cup body and a fixing element, wherein said fixing element is a stamped tab affixed to said fuel cup body, and in that said stamped tab is designed to be engaged to said holder.

In a further embodiment, said stamped tab is brazed or welded to said fuel cup body. In a further embodiment, said fuel cup body comprises a recess arranged at an outer surface of said fuel cup body, said stamped tab being engaged to said recess. In a further embodiment, an upper end of said stamped tab is bent outward of said fuel cup in a direction being orthogonal to said central longitudinal axis. In a further embodiment, an upper end of said stamped tab is designed T-shaped. In a further embodiment, an upper end of said stamped tab comprises at least one aperture.

In another embodiment, a fuel cup including a central longitudinal axis is fixable to an injector via a holder, and comprises a fuel cup body and a fixing element, and the fixing element is a stamped tab affixed to said fuel cup body, and provided to be engaged to said holder, and the fuel cup body comprises a recess arranged at an outer surface of the fuel cup body, the stamped tab being engaged to the recess.

BRIEF DESCRIPTION OF THE DRAWINGS

Example embodiments will be explained in more detail below with reference to figures, in which.

DETAILED DESCRIPTION

Some embodiments provide a fuel cup comprising a fixing element, such an arrangement being fixable to an injector, whereby this arrangement can be manufactured faster, cheaper, and by applying less complicated production steps during manufacture.

Figure 1:
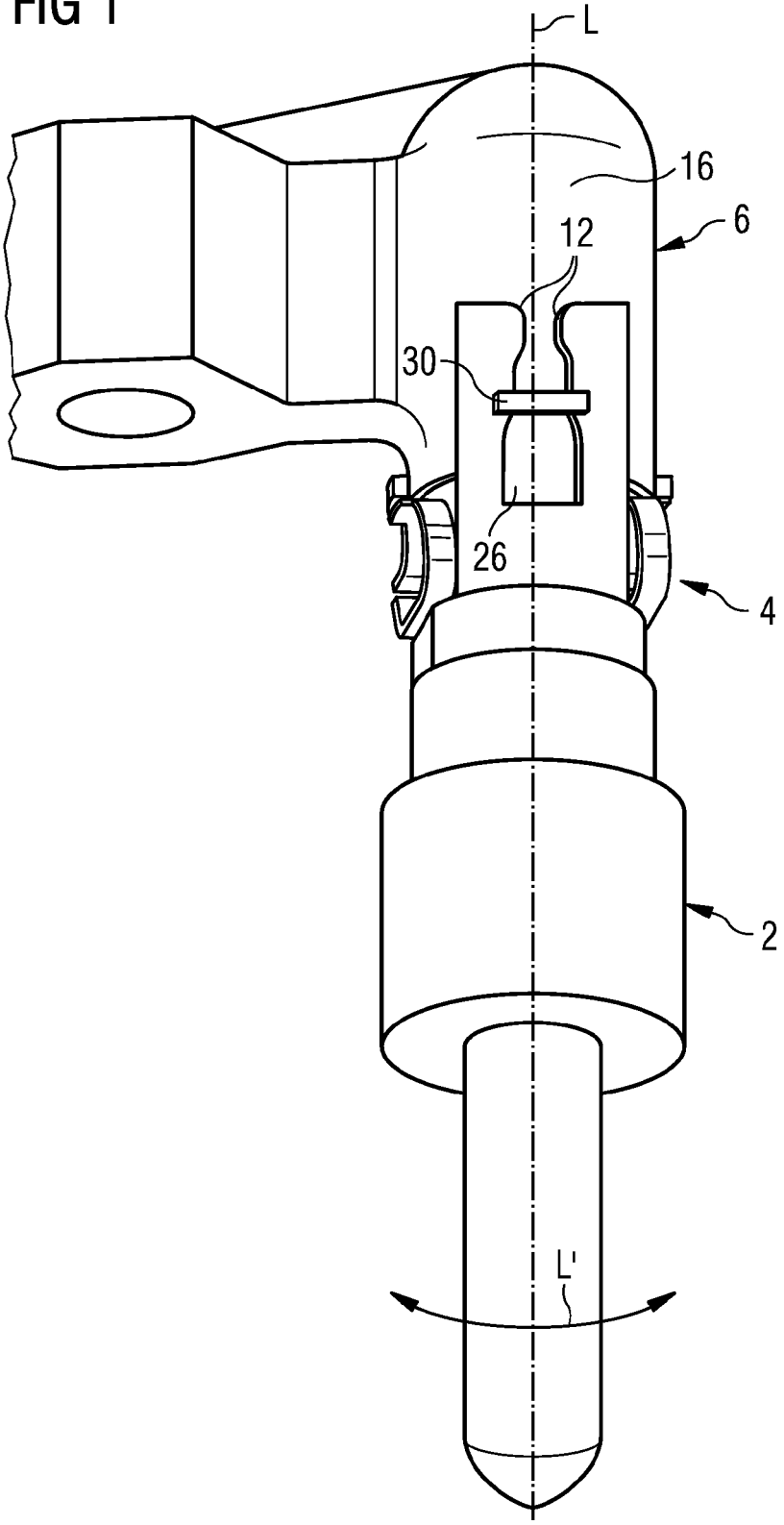
FIG. 1: an injector assembly including a fuel cup according to one embodiment, a holder, and an injector.

FIG. 1 shows a fuel cup 6 fixed to an injector 2 and a holder 4. The holder 4 and the injector 2 may be of the same construction as disclosed in prior art EP 1 892 408 A1. The fuel cup 6 is leak proof fixed to the injector 2 so that fuel may flow, under pressure, from a fuel rail 10 (not shown in FIG. 1, but in FIGS. 6 and 7) through the fuel cup 6 into the injector 2 for being injected into the cylinder head of an internal combustion engine (not shown). The fuel cup 6 comprises a fuel cup body 16 and a fixing element. Whereas the prior art fixing element is an integral part of the fuel cup, the fixing element of the fuel cup disclosed herein is a separate part in the form of a stamped tab 26, which is affixed to the fuel cup body 16. Accordingly, the disclosed fuel cup comprises (at least) two parts, namely the fuel cup body 16 and the stamped tab 26, which can be manufactured separately and independent from each other, and then be affixed to each other.

Compared with certain known fuel cups the fuel cup disclosed herein can be produced faster, by means of production processes and steps being less complicated, and with machines and tools being considerably cheaper in acquisition and maintenance. The fuel cup body 16 can be a forged or cast part. The fuel cup body 16 may be a stamped part, in particular a deep drawn part. In one development, producing the fuel cup body 16 comprises a step of machining for optimization.

For gaining these advantages, the fact that the fuel cup body and the stamped tab can be manufactured separately and independently from each other may be essential.

Fixing of the injector 2 in the fuel cup 6 along a central longitudinal axis L of the fuel cup 6 as well as in a rotational direction L' around said central longitudinal axis L is accomplished by means of said holder 4, in connection and interaction with the stamped tab 26. Said fixing is essential, as any person skilled in the art knows, not only for having the fuel path from the fuel rail 10 to the cylinder head free of any leakage, even with higher pressures as used like in modern engines provided with gasoline direct injection or with diesel engines, but also for complying with the (more and more) restrictive rules defining limit values, which the exhaust gas must not exceed. Said fixing also has the advantage that a combination of fuel rail, fuel cup(s), holder(s) and injector(s) can be preassembled prior to mounting to an internal combustion engine or can be removed from such an engine (for instance for purposes of maintenance or repair) without loosing the orientation of the injectors with respect to their correct position in the cylinder head.

Said fixing is mainly accomplished by interaction between the stamped tab 26 of the fuel cup 6 and, for example, with fork-like extensions 12 of the holder 4. This can be seen in more details in the other figures of the drawing.

The stamped tab 26 may be affixed to the fuel cup body 16 by brazing or welding, whereby the fuel cup body 16 may comprise a recess 32 (see FIGS. 2, 3, 6, and 7) for receiving the stamped tab 26. Affixing may also be accomplished without the provision of said recess 32, i.e., directly onto the outer surface of the fuel cup body 16.

Figure 2:
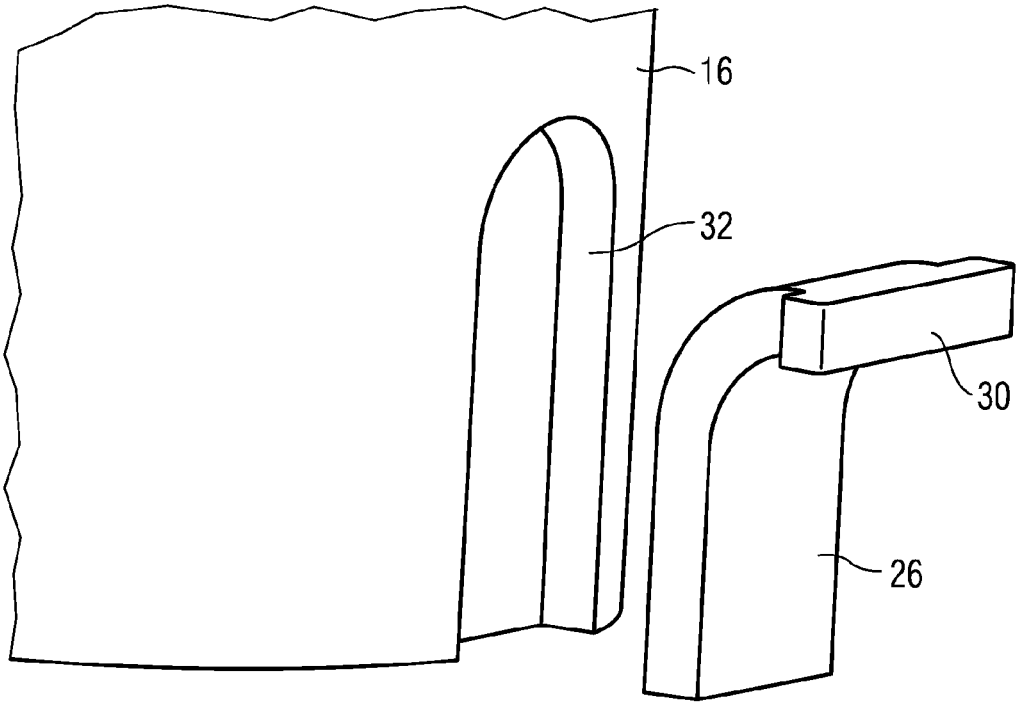
FIG. 2: a fuel cup body (partially) and a stamped tab both parts not yet affixed to each other.

FIG. 2 shows, in greater details, part of the fuel cup body 16 and the stamped tab 26, not yet fixed to each other. An outer surface of the fuel cup body 16 is provided with a groove or a recess 32, designed to receive and engage the stamped tab 26 either by brazing or by welding or by interference, or by any other method being applicable.

Figure 3:
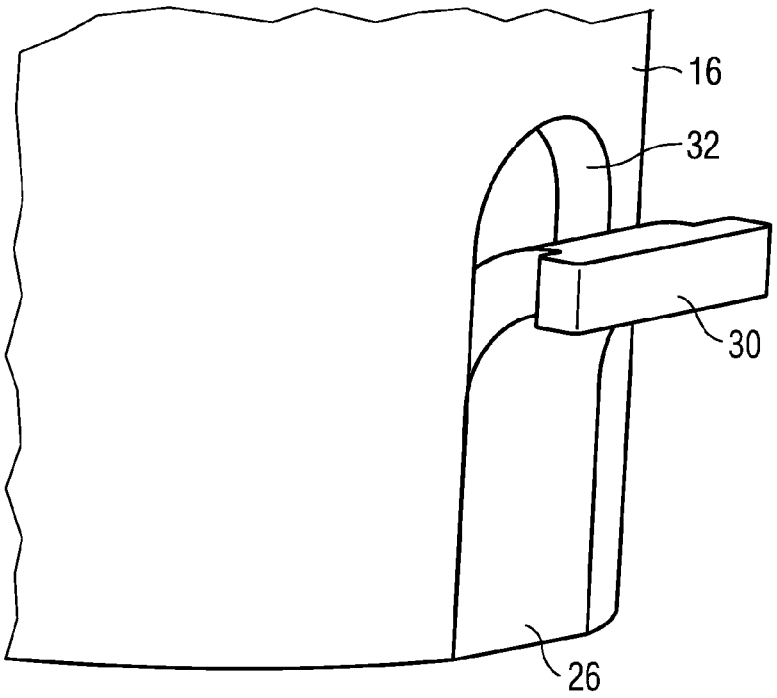
FIG. 3: the arrangement of FIG. 2, but affixed to each other.

FIG. 3 shows the stamped tab 26 fixed to the fuel cup body 16 in the area of the recess 32.

Figure 4:
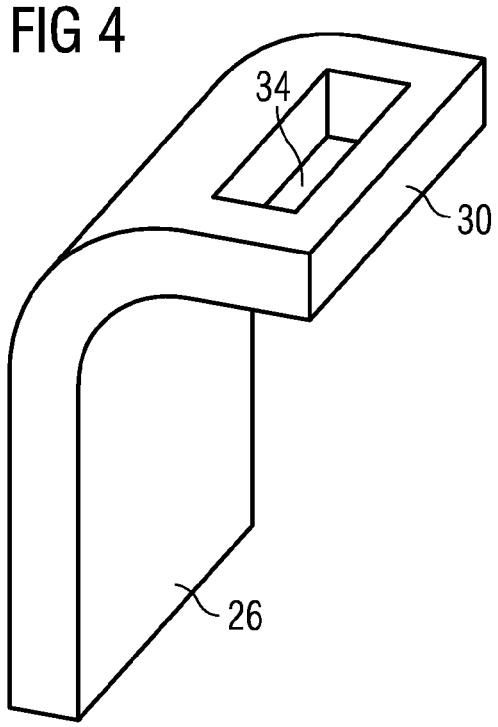
FIGS. 4 and 5: two embodiments of a stamped tab.
Figure 5:
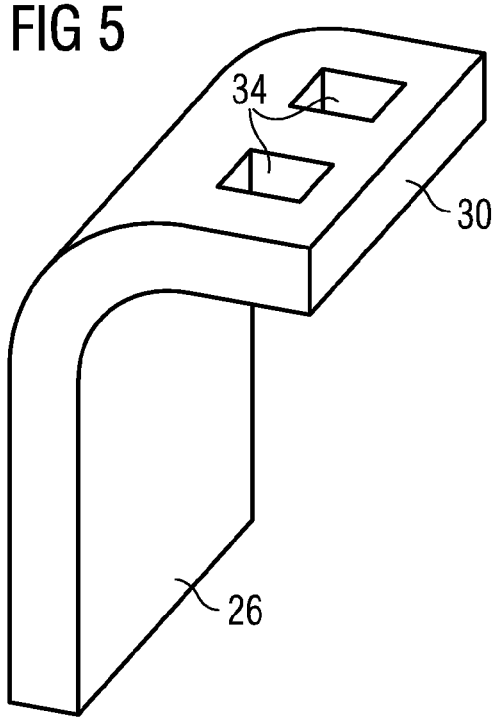

The figures also show another embodiment of the stamped tab 26: an upper end 30 of the stamped tab 26 is bent outward in a direction orthogonal to the central longitudinal axis L. with the embodiments shown in FIGS. 2, 3, 6, and 7 the upper end 30 of the stamped tab 26 is designed T-shaped, whereas with the embodiments according to the FIGS. 4 and 5 the upper end 30 comprises one (FIG. 4) or two apertures 34 (FIG. 5).

Figure 6:
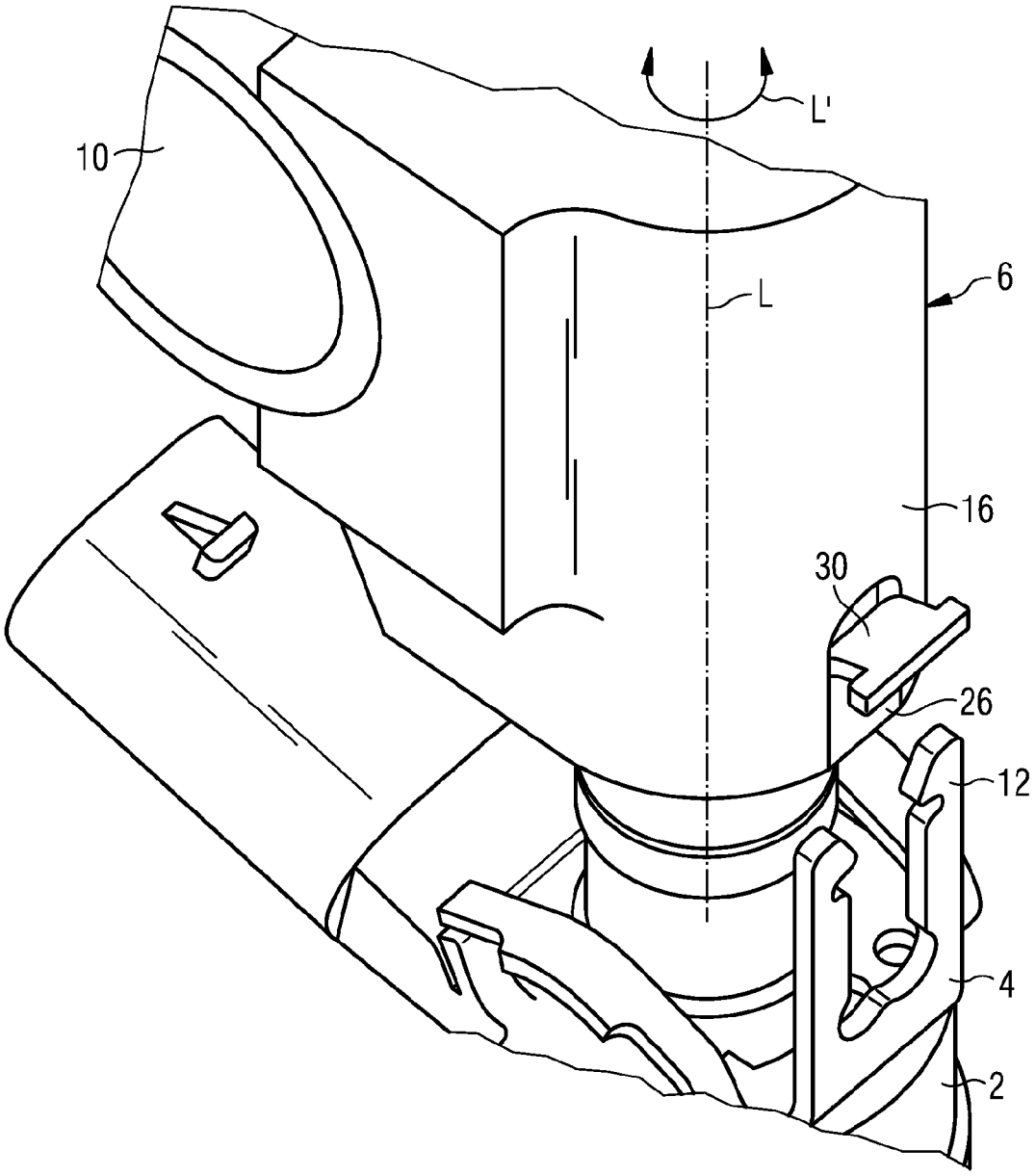
FIG. 6: an arrangement of a fuel cup, a holder, and an injector, before being assembled
Figure 7:
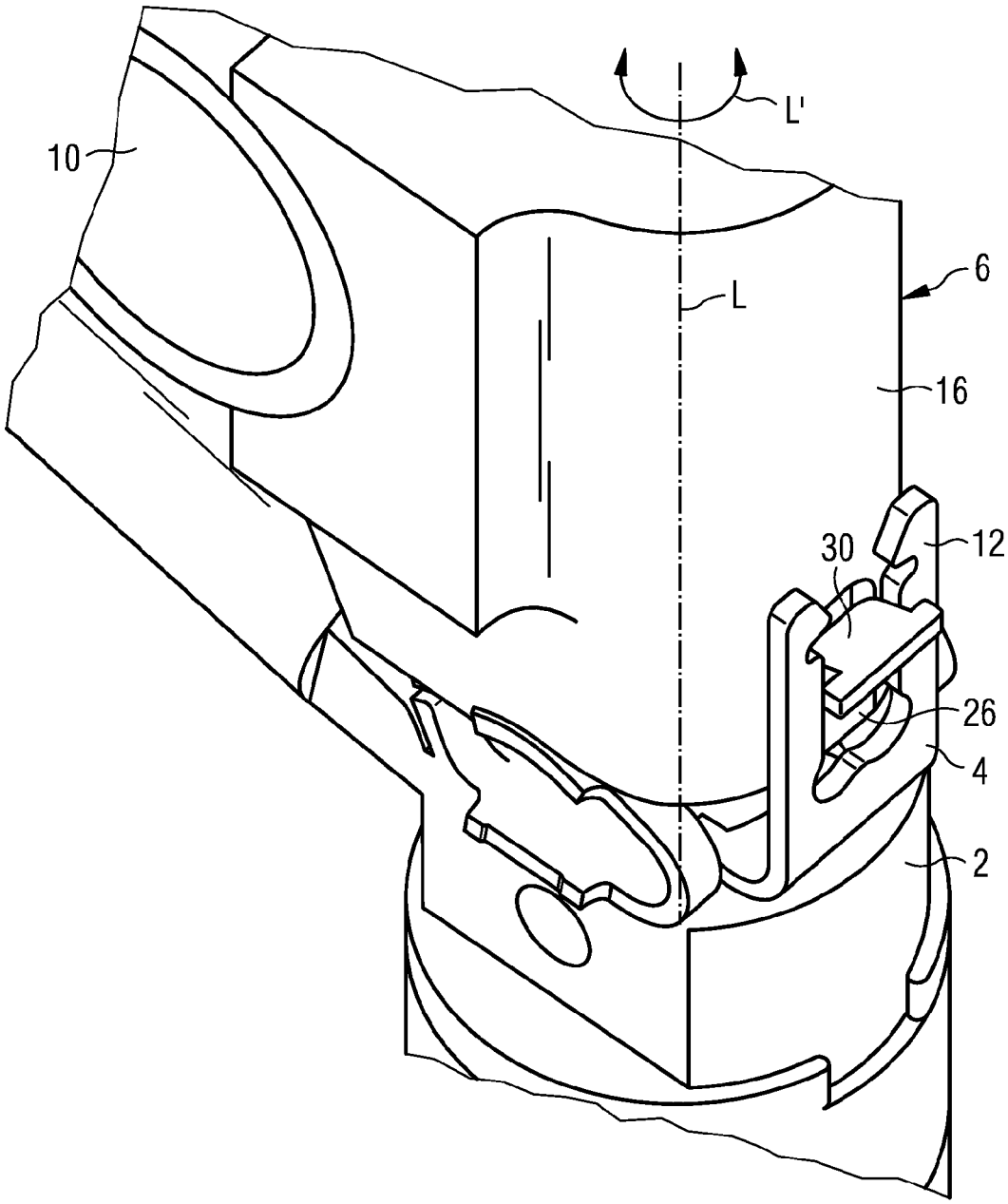
FIG. 7: the arrangement of FIG. 6, after having been assembled.

The advantage of the T-shaped design of the upper end 30 of the stamped tab 26 can be seen from FIGS. 6 and 7:

FIG. 6 shows an injector 2, a holder 4, and a fuel cup 6 including the fuel cup body 16 and the stamped tab 26, fastened to the fuel cup body 16 in the area of the recess 32. whereas the holder 4 is already mounted to the injector 2 (see said prior art EP 1 892 408 A1), the fuel cup 6 is not yet mounted to the injector 2 and the holder 4. With this embodiment the holder 4 comprises two fork-like extensions 12, as already described. When pressing down the fuel cup 6 along its central longitudinal axis L in direction to the injector 2, the stamped tab 26 glides into the area between the two fork-like extensions 12 of the holder 4, whereby said extensions 12 slide into the area between the outer surface of the fuel cup body 16 and the T-shaped area of the upper end 30 of the stamped tab 26. Due to the geometrical design of the extensions 12 the fork-like extensions 12 are first forced apart and then they spring back again. As a result, the stamped tab 26 is clamped between said two fork-like extensions 12 of the holder 4 in a way so that the fuel cup 6 can neither move in a direction along the central longitudinal axis L off from the holder 4 and from the injector 2 nor can it be distorted in a rotational direction L' around the central longitudinal axis L. As a result, the fuel cup 26, the holder 4 and injector 2 are fixed to each other. This situation is demonstrated in FIG. 7.

In other embodiments, where the upper end 30 of the stamped tab 26 is designed to have one or two apertures 34 (see FIGS. 4 and 5), one fork-like extension 12 of the holder 4 (or both in case of two apertures 34) slide(s) through the aperture 34 (or, respectively, through the apertures 34), when fuel cup 26, holder 4 and injector 2 are assembled. Accordingly, also with these embodiments said fixing may be accomplished very precisely.

The invention is not limited to specific embodiments by the description on the basis of said exemplary embodiments but comprises any combination of elements of different embodiments. Moreover, the invention comprises any combination of claims and any combination of features disclosed by the claims.

What is claimed is:

1. A fuel cup, comprising:

a fuel cup body having a central longitudinal axis and a first end for receiving an injector via a holder, and a fixing element comprising a tab, the first end of the fuel cup body having a nominal outside diameter, and a recess in a side wall of the fuel cup body extending from the first end parallel to the central longitudinal axis, wherein the tab includes:

a rectangular lower portion affixed within the recess of the fuel cup body, the rectangular lower portion mounted flush with a wall of the fuel cup body so that the rectangular lower portion does not extend beyond the nominal outside diameter of the first end of the fuel cup, and an upper portion bent outward to protrude from the recess in a direction orthogonal to the central longitudinal axis extending away from the fuel cup body at a point remote from the first end of the fuel cup body and configured for engagement with said holder.

2. The fuel cup according to claim 1, wherein the rectangular lower portion of the tab is brazed or welded to said fuel cup body.

3. The fuel cup according to claim 1, wherein said fuel cup body comprises a top and a bottom, the top configured for connection to a common rail of an internal combustion engine, the bottom open for receipt of a portion of a fuel injector.

4. The fuel cup according to claim 1, wherein the upper portion of the tab comprises at least one aperture.

5. A fuel cup for a high pressure fuel injection system of an internal combustion engine, the fuel cup having a central longitudinal axis, and comprising:

a cast or forged fuel cup body, and a fixing element, the fuel cup body having a top end and a bottom end, the top end fixable to a common rail of an internal combustion engine, the bottom end fixable to a fuel injector via a holder, the fuel cup body having inner and outer surfaces, the bottom end having a nominal outside diameter, the fixing element comprising a tab having upper and lower ends, the lower end including a rectangular portion affixed to the outer surface adjacent the bottom of the fuel cup body, the upper end bent outward from the fuel cup body and extending away from the fuel cup body at a point remote from the bottom of the fuel cup body and configured for engagement with the holder, wherein the fuel cup body comprises a recess formed in a portion of the outer surface of the bottom of the fuel cup body, the recess sized to receive the lower end of the tab, the lower end of the tab brazed or welded within the recess in the outer surface of the fuel cup body such that the affixed portion of the tab lies substantially flush with the outer surface of the fuel cup body surrounding the recess and does not extend beyond the nominal diameter of the bottom end.

6. A method for fabricating a fuel cup, the method comprising:

forming a fuel cup body having a central longitudinal axis and a first end for receiving an injector via a holder by a casting process;

forming a fixing element comprising a tab using a stamping process;

wherein the first end of the fuel cup body has a nominal outside diameter and a recess in a side wall of the fuel cup body extending from the first end parallel to the central longitudinal axis;

wherein the tab includes a rectangular lower portion and an upper portion bent outward;

affixing the fixing element within the recess of the fuel cup body by brazing or welding;

wherein the rectangular lower portion of the tab is mounted flush with a wall of the fuel cup body so that the rectangular lower portion does not extend beyond the nominal outside diameter of the first end of the fuel cup; and the upper portion of the tab protrudes from the recess in a direction orthogonal to the central longitudinal axis extending away from the fuel cup body at a point remote from the first end of the fuel cup body.

7. The method according to claim 6, wherein the fuel cup body comprises a top and a bottom, the top configured for connection to a common rail of an internal combustion engine, the bottom open for receipt of a portion of a fuel injector.

8. The method according to claim 6, wherein the upper portion of the tab comprises at least one aperture.

* * * * *